US010653259B2

(12) United States Patent
Wilson

(10) Patent No.: US 10,653,259 B2
(45) Date of Patent: May 19, 2020

(54) MULTIPLE PAIR PANT HANGER

(71) Applicant: Gregory Scott Wilson, Medicine Hat (CA)

(72) Inventor: Gregory Scott Wilson, Medicine Hat (CA)

( * ) Notice: Subject to any disclaimer, the term of this patent is extended or adjusted under 35 U.S.C. 154(b) by 64 days.

(21) Appl. No.: 16/104,811

(22) Filed: Aug. 17, 2018

(65) Prior Publication Data

US 2020/0054159 A1 Feb. 20, 2020

(51) Int. Cl.

| | |
|---|---|
| ***A47G 25/18*** | (2006.01) |
| ***A47G 25/06*** | (2006.01) |
| ***A47G 25/30*** | (2006.01) |

(52) U.S. Cl.

CPC ..... *A47G 25/18* (2013.01); *A47G 25/06* (2013.01); *A47G 25/30* (2013.01)

(58) Field of Classification Search

CPC .... A47G 25/18; A47G 25/06; A47G 25/0635; A47G 25/0657; A47G 25/0664; A47G 25/0685; A47G 25/48; A47G 25/481; A47G 25/488; A47G 25/50; A47G 25/30; A47G 25/28; A41D 27/22; A47F 7/18; A47F 7/19; A47F 7/24; A47F 7/26; A47L 13/512

See application file for complete search history.

(56) References Cited

U.S. PATENT DOCUMENTS 620,261 A * 2/1899 Thorpe ..... A47G 25/0657 248/316.3
1,248,732 A * 12/1917 Shave et al. ..... A47G 25/10 211/30
1,417,009 A * 5/1922 Woodward ..... A47G 25/487 223/91
2,590,297 A * 3/1952 Curtis ..... A47G 25/0657 248/316.3
3,168,954 A * 2/1965 Von Herrmann ..... A47G 1/21 211/50
3,262,579 A * 7/1966 Reich ..... A47K 10/12 211/45
4,058,222 A 11/1977 Singer
4,278,177 A 7/1981 Fahmi
4,515,277 A * 5/1985 Leth-Sorensen ..... G09F 1/10 211/45
5,592,721 A * 1/1997 Zeller ..... B42F 15/066 24/115 L
5,711,430 A * 1/1998 Andersen ..... A47G 1/21 211/45
5,884,779 A * 3/1999 Rich ..... H05K 7/1404 211/41.17
6,964,342 B2 11/2005 Wenzler
7,861,901 B2 1/2011 Kirschbaum
9,738,110 B2 * 8/2017 Caron ..... B42F 1/00

(Continued)

*Primary Examiner* — Ismael Izaguirre
(74) *Attorney, Agent, or Firm* — Acumen IP LLC; Michael C. Balaguy

(57) ABSTRACT

An apparatus for hanging at least one article of clothing; the multiple pair pant hanger is mountable horizontally, having slots and rollers enabling the pant legs to slip into to hold the pants to dry. The pant hanger is either mounted to a wall or hung from a back of a door, which allows an individual to take multiple pairs of wet pants out of a washing machine, or damp from a dryer, and hang from the bottom of the legs of the pants to dry completely without shrinking the pants and without leaving hanger marks.

6 Claims, 5 Drawing Sheets

(56) References Cited

U.S. PATENT DOCUMENTS

| | | | | |
|---|---|---|---|---|
| 2008/0152409 | A1* | 6/2008 | Funada ..... | G03G 15/6552<br>399/405 |
| 2012/0018464 | A1 | 1/2012 | Gamboa | |

* cited by examiner

MULTIPLE PAIR PANT HANGER

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of garment hangers and more specifically relates to a hanging rack for pants.

2. Description of Related Art

Many people wear clothing garments on a daily basis. Conventional hangers for trousers, skirts and the like ordinarily hold a single garment with a horizontal bar and a top hook for hooking over a closet rod. In many cases, the number of garments that need to be stored exceeds the space or hangers available. This has led to the development of several prior art devices which attempt to provide solutions in maximizing clothes storage.

Such organizers include telescoping supports or racks or pivoting racks which mount to a closet wall or an existing closet horizontal bar. Other prior racks and hanging devices pertinent hereto include a vertically extending post from which a plurality of vertically spaced horizontal support arms is pivotally connected enabling pairs of pants, skirts, and other types of clothing to be suspended therefrom. When the clothes are hung on these arms, they are radially spaced and take on a helical pattern. Some of these include telescoping brackets for anchoring the organizers to the wall of a closet.

While there have been some advances in maximizing closet storage, there remains a need to provide an improved hanging device for pants and other garments which is simpler to use and reliably retains garments in a non-wrinkling manner.

U.S. Pat. No. 6,964,342 to Michael James Wenzler relates to a hanging device. The described hanging device includes a hanging device having a base that is to be connected to a vertical support or wall, with its long axis of the base vertically disposed. A plurality of horizontally disposed retainers extend across a front face of the base, wherein each retainer includes a pair of retainer members which are biased toward one another. The members are configured to be movably displaced from one another to readily permit the insertion of an article to be hung, such as a garment, therebetween.

BRIEF SUMMARY OF THE INVENTION

In view of the foregoing disadvantages inherent in the known garment hanger art, the present disclosure provides a novel multiple pair pant hanger. The general purpose of the present disclosure, which will be described subsequently in greater detail, is to provide a multiple pair pant hanger that is mounted horizontally, with slots and rollers that the pant legs slip into to hold them to dry. The multiple pair pant hanger is energy efficient, simple to use, prevents pant legs from shrinking, eliminates hanger marks, and works for virtually any type of pants, sweats, shorts, skirts or the like.

The multiple pair pant hanger may either be mounted to a wall or hung from a back of a door, allowing an individual to take multiple pairs of wet pants out of washing machine, or damp from dryer, and hang from the bottom of the legs to dry the pants completely without shrinking the pants.

An apparatus for hanging at least one article of clothing is disclosed herein. The apparatus for hanging at least one article of clothing includes a rack including a frame construction having a first-side, a second-side, a top, a bottom, a front, and a back. The rack may also include at least one receiver configured to receive and removably retain at least one article of clothing. Preferably, the receiver may comprise an arcuate opening in the frame construction. The rack may further include at least one roller configured to biasingly engage the at least one article of clothing in place to the at least one receiver. The apparatus for hanging at least one article of clothing also includes a rack-mount structured and arrange to fixedly mount the rack in a location above a ground surface. As may be appreciated, the at least one receiver has a bottom-entry-channel suitable for receiving and securing to hang the at least one article of clothing in a manner that prevents pant legs from shrinking and eliminates hanger marks.

A method of using the apparatus for hanging at least one article of clothing is also disclosed herein. The method of using the apparatus for hanging at least one article of clothing may comprise the steps of: providing the apparatus for hanging multiple pairs of pants; fixedly-mounting a rack of the apparatus to at least one wall or door above a ground surface via a rack-mount; positioning at least one roller within at least one receiver of the rack; and hanging the pants by biasingly-engaging the at least one roller to an inner-edge of the at least one receiver.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a multiple pair pant hanger, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to garment hangers and more particularly to a multiple pair pant hanger as used to improve the efficient and effective hanging of multiple pairs of pants.

Generally, the multiple pair pant hanger is an apparatus that may be mounted horizontally, with slots and rollers that the pant legs slip into to hold them to dry. The pant hanger may either be mounted to a wall or hung from a back of a door, that allows an individual to take multiple pairs of wet pants out of a washing machine, or damp from a dryer, and hang from the bottom of the legs to dry completely without shrinking or leaving hanger marks on the pants.

Referring now more specifically to the drawings by numerals of reference, there is shown in FIGS. 1-4, various views of an apparatus 100 for hanging at least one article of clothing 5.

Figure 1:
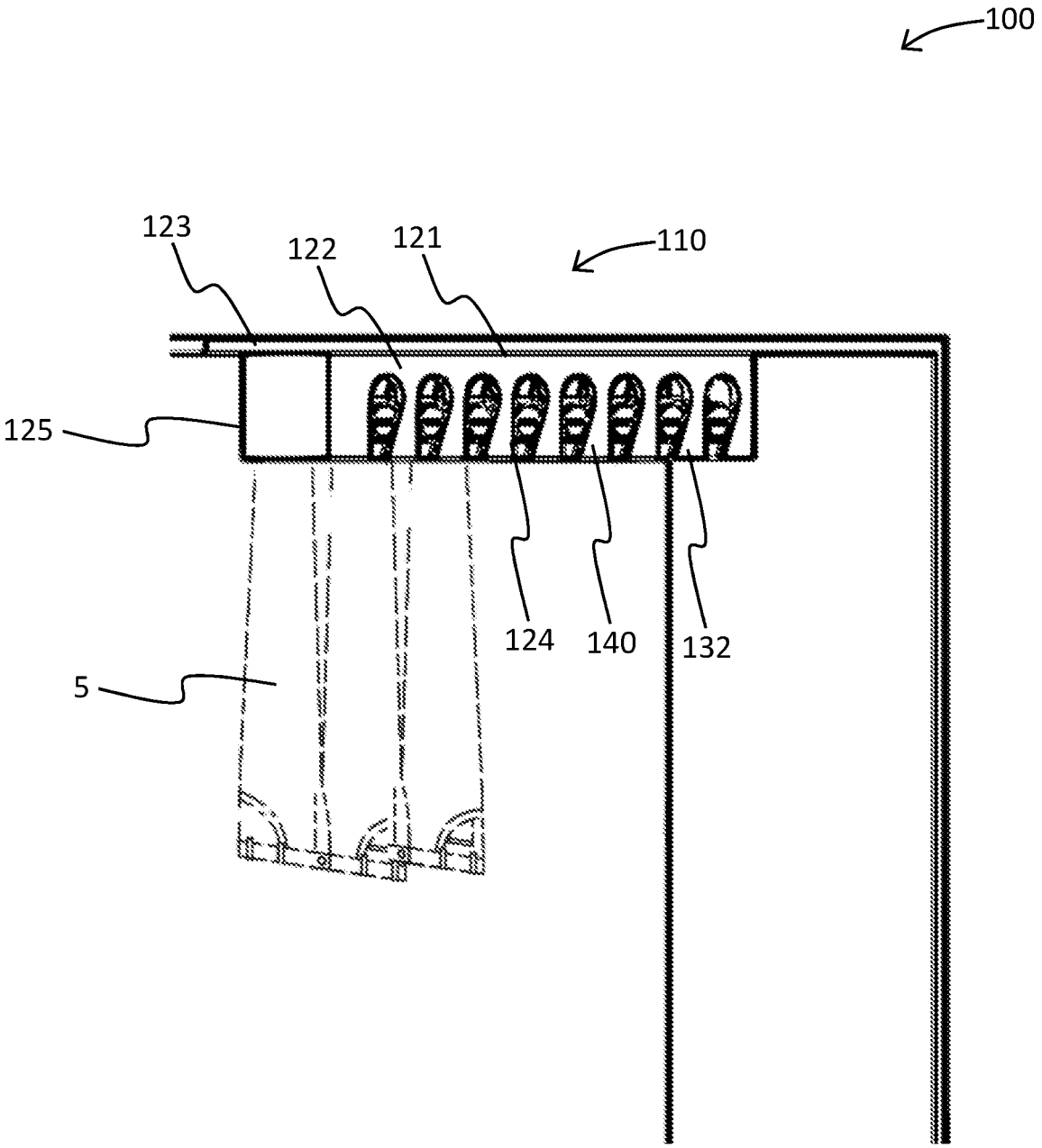
FIG. 1 is a perspective view of the apparatus for hanging at least one article of clothing during an 'in-use' condition, according to an embodiment of the disclosure.

FIG. 1 shows the apparatus 100 for hanging at least one article of clothing 5 during an 'in-use' condition 50 by a user 40, according to an embodiment of the present disclosure. As illustrated, the apparatus 100 for hanging at least one article of clothing 5 may include a rack 110 comprising a frame construction 120, at least one receiver 130, and at least one roller 140. The apparatus 100 may further comprise a rack-mount 150. Preferably, the frame construction 120 comprises rigid material, such as wood, metal, or plastic.

In continuing to refer to FIG. 1, the rack 110 includes the frame construction 120 having a first-side 121, a second-side 122, a top 123, a bottom 124, a front 125, and a back 126. The rack 110 further comprises at least one receiver 130, the at least one receiver 130 configured to receive and retain the at least one article of clothing 5 (i.e., pants).

The receiver 130 may preferably comprise an arcuate opening 132 in the frame construction 120. The frame construction 110 may also comprise at least one roller 140, the at least one roller 140 configured to biasingly engage the at least one article of clothing 5 in place to the at least one receiver 130.

The apparatus 100 for hanging at least one article of clothing 5 may further comprise a rack-mount 150. The rack 110 and the rack-mount 150 structurally and functionally combine to fixedly mount the rack 110 in a location above a ground surface. As may be appreciated, the at least one receiver 130 has a bottom-entry-channel 134 suitable for receiving and securing to hang the at least one article of clothing 5.

In one embodiment, the rack-mount 150 may comprise a plurality of screws and nails that may be used in combination to bolt or mount the apparatus 100 for hanging at least one article of clothing 5 to a ceiling surface or a wall surface.

In another embodiment, the rack-mount 150 may comprise at least one hook. The at least one hook may be fixedly or removably installed to a back of a door. The at least one hook may work to hang the apparatus 100 for hanging at least one article of clothing 5 thereto.

In yet another embodiment, the rack-mount 150 may comprise a high-grade adhesive useful for adhering the apparatus 100 for hanging at least one article of clothing 5 to the ceiling surface or at least one wall surface.

Figure 2:
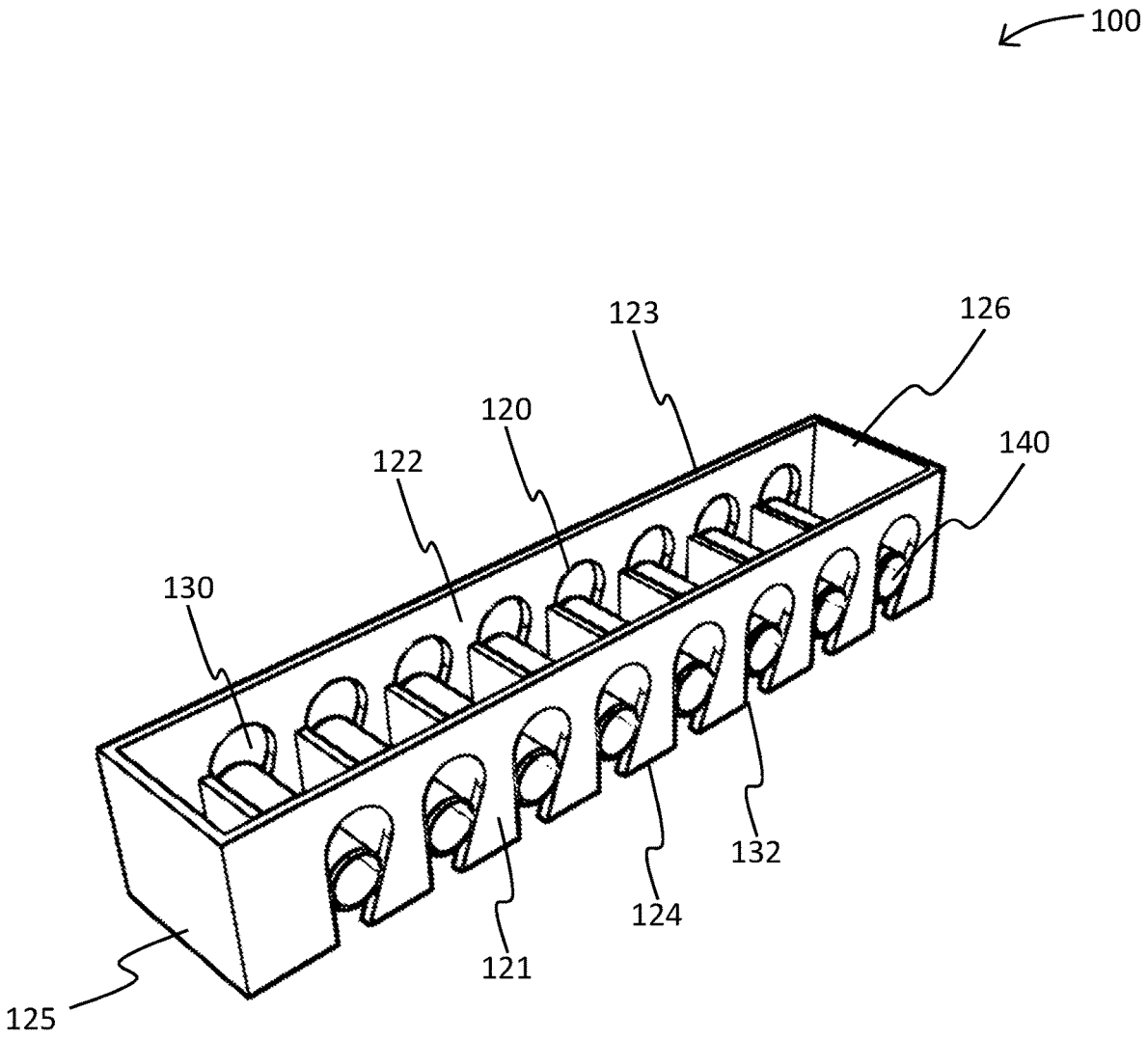
FIG. 2 is a top view of the apparatus for hanging at least one article of clothing of FIG. 1 comprising a frame construction having a plurality of receivers and a plurality of rollers, according to an embodiment of the present disclosure.

Referring now to FIG. 2 showing a top view of the apparatus 100 for hanging at least one article of clothing 5 of FIG. 1, according to an embodiment of the present disclosure. As above, the apparatus 100 for hanging at least one article of clothing 5 may include a rack 110, a frame construction 120, a receiver 130, a roller 140, a rack-mount 150, and a runner 160.

Figure 3:
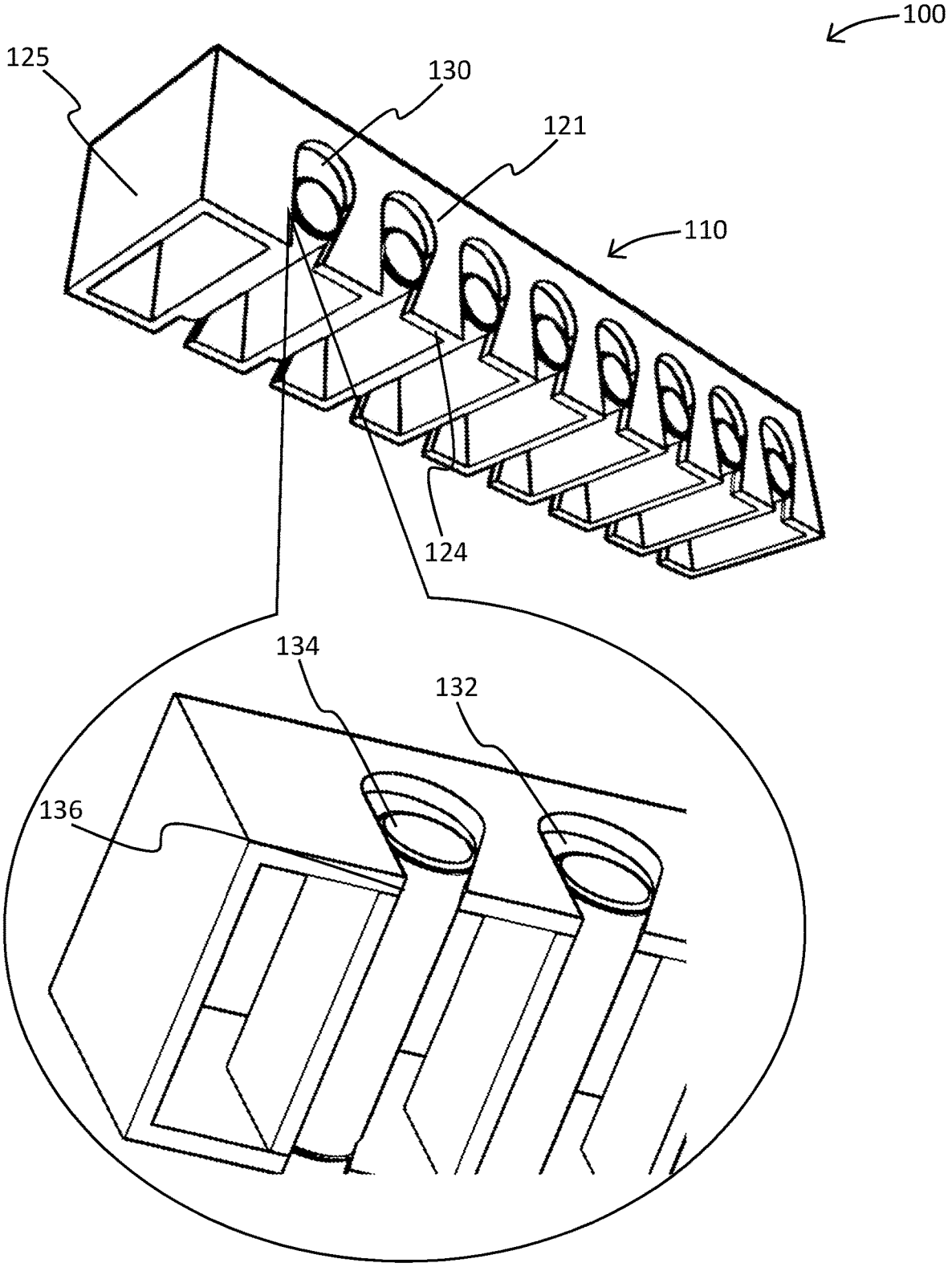
FIG. 3 is a detail view of the apparatus for hanging at least one article of clothing of FIGS. 1-2, according to an embodiment of the present disclosure.

FIG. 3 shows a detail view of the apparatus 100 for hanging at least one article of clothing 5 of FIGS. 1 and 2, according to an embodiment of the present disclosure. As above, the apparatus 100 for hanging at least one article of clothing 5 may include a rack 110, a frame construction 120, a receiver 130, a roller 140, a rack-mount 150, and a runner 160.

As shown, the bottom-entry-channel 134 may be configured such that it is slightly rearward of a top-portion of the at least one receiver 130. An edge of the at least one receiver 130 comprises a runner 160. The runner 160 may be useful for providing a smooth surface for frictionally-retaining the at least one article of clothing 5 when pinched thereto via the at least one roller 140.

In one embodiment, the frame construction 120 comprises a first-plurality of the receivers 130, the first-plurality of the receivers 130 running in series along the first-side 121 of the frame construction 120. In the same embodiment, the frame construction 120 may comprise a second-plurality of the receivers 130, the second-plurality of the receivers 130 running in series along the second-side 122 of the frame construction 120. As illustrated, the second-plurality of the receivers 130 are opposite and adjacent the first-plurality of the receivers 130.

In continuing to refer to FIG. 3, the at least one roller 140 may be configured to fit within the receiver 130 of the first-plurality of receivers 130 and an opposing the receiver 130 of the second-plurality of receivers 130. As may be appreciated, the at least one roller 140 may be configured to frictionally pinch the at least one article of clothing 5 against the edge of the at least one receiver 130 for holding the at least one article of clothing 5 in place. The at least one roller 140 may comprise deformable material (such as foam).

As shown, the rack 110 may include a first-plurality of receivers 130 running horizontally in series along the first-side 121 of the frame construction 120; a second-plurality of the receivers 130 running horizontally in series along the second-side 122 of the frame construction 120, the second-plurality of the receivers 130 configured in alignment opposite the first-plurality of receivers 130.

The rack may further include a plurality of rollers 140. Preferably, the at least one receiver 130 comprises an arcuate opening in the first-side 121 and the second-side 122 of the frame construction. The receivers 130 may be configured in pairs, such that the pairs of receivers 130 are configured to retain each respective the roller 140, the roller 140 configured to biasingly engage the pair of pants in place to the at least one receiver 130. The rack 110 is mountable above a ground surface. The pair of receivers 130 comprises a bottom-entry-channel for receiving and hanging the pair of pants via the roller 140.

Figure 4A:
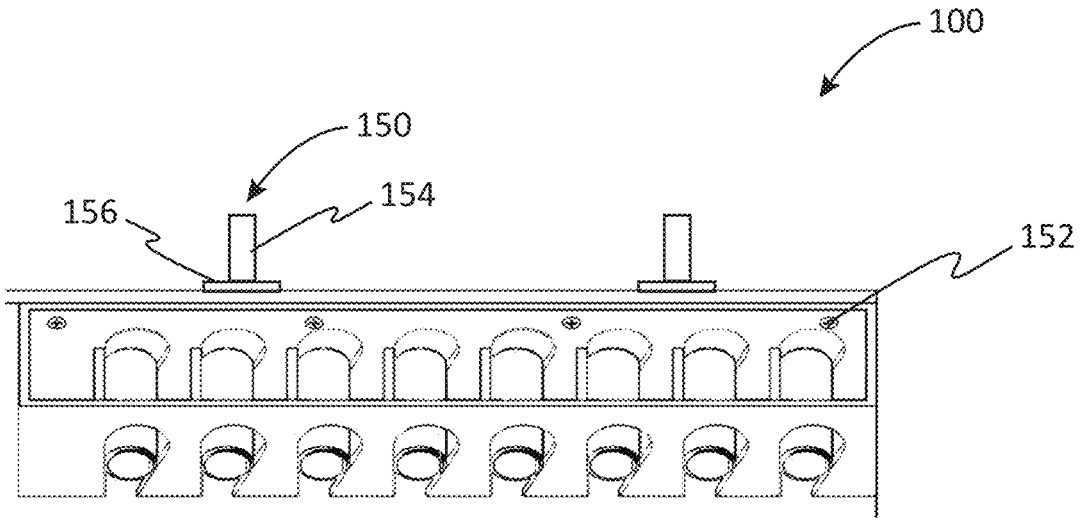
FIG. 4A is a perspective view showing a means of mounting the apparatus for hanging at least one article of clothing of FIGS. 1-3 to a wall utilizing screws, according to an embodiment of the present disclosure.

Referring now to FIG. 4A showing a perspective view of the apparatus 100 for hanging at least one article of clothing 5 of FIGS. 1-3, according to an embodiment of the present disclosure. As above, the apparatus 100 for hanging at least one article of clothing 5 may include a rack 110 and a rack-mount 150. In one embodiment, the present invention may specifically comprise an apparatus 100 for hanging multiple pairs of pants. The apparatus 100 may comprise a rack 110 including a frame construction 120 having a first-side 121, a second-side 122, a top 123, a bottom 124, a front 125, and a back 126.

As shown in FIG. 4A, the apparatus 100 for hanging at least one article of clothing 5 may be mounted to a wall via a plurality of screws 152. It should be noted that the plurality of screws 152 inserted through either the first-side 121, the second-side 122, the front 125, and alternatively the back 126 of the frame construction 120 (or any combination as deemed appropriate). Rack-mount 150 may comprise at least one hook 154. Further, rack-mount 150 may comprise at least one hinge 156 which is configured to swing hook 154 approximately 90 degrees outward from a back of said door between a 'non-use' condition and an 'in-use' condition.

Figure 4B:
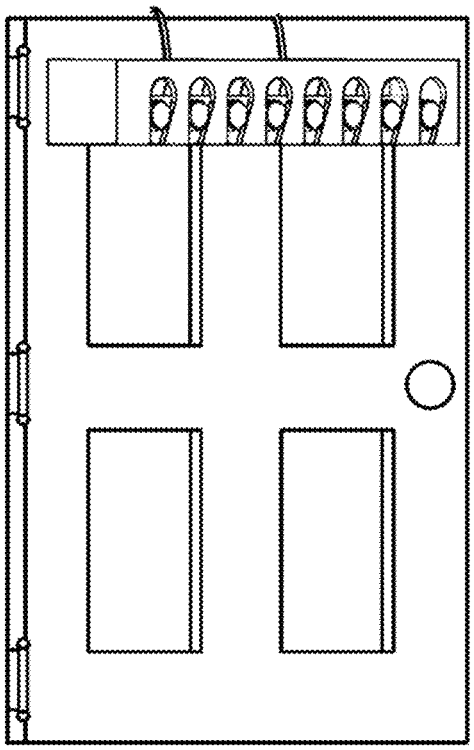
FIG. 4B is a perspective view showing a means of hanging the apparatus for hanging at least one article of clothing of FIGS. 1-3 to a door utilizing at least one hook, according to an embodiment of the present disclosure.

Referring now to FIG. 4B showing a means of hanging the apparatus 100 for hanging at least one article of clothing 5 of FIGS. 1-3 to a door utilizing a rack-mount 150 comprising at least one hook, according to an embodiment of the present disclosure. As shown, the hook may be removably or fixedly installed to a top of the door and connect to the back 126 of the frame construction 120. In such a manner, the apparatus 100 for hanging at least one article of clothing 5 may be conveniently and removably installed for use by the user 40 in a manner that is space efficient. As may be appreciated, the rack-mount 150 comprising the at least one hook may comprise a French hook, cleats, a headboard hook, or any other hook as is known and understood in the art.

As may be appreciated, the at least one article of clothing 5 may comprise pants (such as jeans, khakis, slacks, trousers, dress pants, and the like). Preferably, the pants may be folded at the crease of each leg such that the legs of the pants overlap. The bottom of the pants may be pinch-retained by the roller 140 at the receiver 120 of the apparatus 100. Alternatively, the at least one article of clothing may comprise skirts, shorts, shirts, jackets, under garments, and the like.

According to one embodiment, the apparatus 100 for hanging at least one article of clothing 5 may be arranged as a kit. The kit may include the apparatus 100 for hanging multiple pairs of pants and may further comprise a set of instructions. The instructions may detail functional relationships in relation to the structure of the apparatus 100 for hanging at least one article of clothing 5 (such that the apparatus 100 for hanging at least one article of clothing 5 can be used, maintained, or the like, in a preferred manner).

Figure 5:
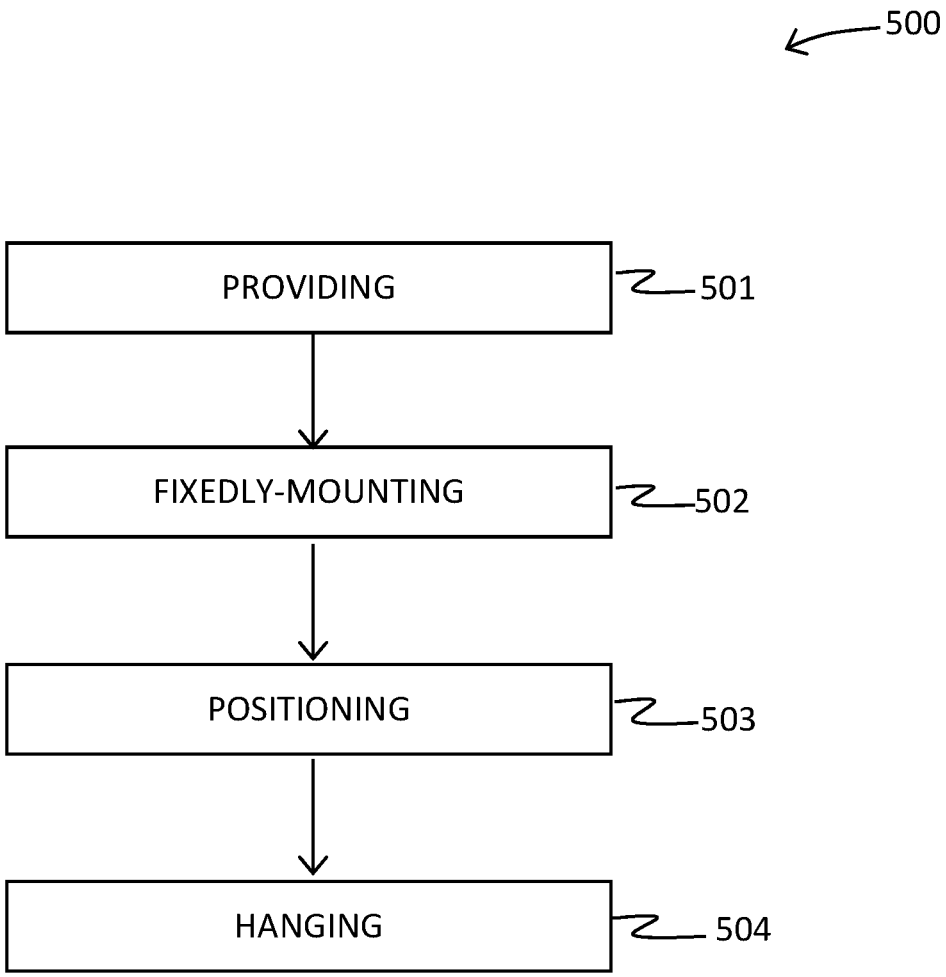
FIG. 5 is a flow diagram illustrating a method of use for the apparatus for hanging at least one article of clothing, according to an embodiment of the present disclosure.

FIG. 5 is a flow diagram 550 illustrating a method 500 for using an apparatus 100 for hanging multiple pairs of pants comprising the steps 500 of: step one 501, providing the apparatus 100 for hanging multiple pairs of pants; step two 502, fixedly-mounting a rack 110 of the apparatus 100 to at least one wall or door above a ground surface via a rack-mount 150; step three 503, positioning at least one roller 140 within at least one receiver 130 of the rack 110; and step four 504, hanging the pants by biasingly-engaging the at least one roller 140 to an inner-edge of the at least one receiver 130.

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the apparatus 100 for hanging at least one article of clothing 5 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An apparatus for hanging at least one article of clothing, the apparatus comprising:

a rack including;

a frame construction having a first-side, a second-side, a top, a bottom, a front, and a back;

at least one receiver, said at least one receiver configured to receive and retain said at least one article of clothing, said receiver comprising an arcuate opening in said frame construction; and at least one roller, said at least one roller configured to biasingly engage said at least one article of clothing in place to said at least one receiver; and a rack-mount;

wherein said rack and said rack-mount structurally and functionally combine to fixedly mount said rack in a location above a ground surface;

wherein said at least one receiver has a bottom-entry-channel suitable for receiving and securing to hang said at least one article of clothing; and further comprising at least one hook, said at least one hook configured to attach to said back of said frame-construction, said at least one hook further configured to removably-attach to a top-portion of a door, and said at least one hook useful for fixedly-suspending the apparatus from said door above a ground surface.

2. The apparatus for hanging at least one article of clothing of claim 1 wherein said at least one hook comprises a hinge, said hinge configured to swing approximately 90 degrees outward from a back of said door between a 'non-use' condition and an 'in-use' condition.

3. The apparatus for hanging at least one article of clothing of claim 1, wherein said rack-mount comprises a plurality of screws configured to mount said frame construction to at least one wall surface and alternatively a ceiling surface.

4. The apparatus for hanging at least one article of clothing of claim 1, wherein said at least one article of clothing comprises pants.

5. The apparatus for hanging at least one article of clothing of claim 1, wherein said frame construction comprises rigid material.

6. The apparatus for hanging at least one article of clothing of claim 1, wherein said bottom-entry-channel is slightly rearward of a top-portion of said at least one receiver;

wherein an edge of said at least one receiver comprises a runner;

wherein said frame construction comprises a first-plurality of said receivers;

wherein said first-plurality of said receivers run in series along said first-side of said frame construction;

wherein said frame construction comprises a second-plurality of said receivers;

wherein said second-plurality of said receivers run in series along said second-side of said frame construction;

wherein said second-plurality of said receivers are opposite and adjacent said first-plurality of said receivers;

wherein said at least one roller fits within said receiver of said first-plurality of receivers and an opposing said receiver of said second-plurality of receivers;

wherein said at least one roller is configured to frictionally pinch said at least one article of clothing against said edge of said at least one receiver for holding said at least one article of clothing in place;

wherein said at least one roller comprises deformable material; and wherein said deformable material comprises foam.

* * * * *